US010070211B2

(12) United States Patent
Fan et al.

(10) Patent No.: US 10,070,211 B2
(45) Date of Patent: Sep. 4, 2018

(54) DIGITAL VOICE PROCESSING METHOD AND SYSTEM FOR HEADSET COMPUTER

(71) Applicant: Kopin Corporation, Westborough, MA (US)

(72) Inventors: Dashen Fan, Seattle, WA (US); Jang Ho Kim, San Jose, CA (US); Yong Seok Seo, Palo Alto, CA (US); John C. C. Fan, Brookline, MA (US)

(73) Assignee: KOPIN CORPORATION, Westborough, MA (US)

( * ) Notice: Subject to any disclaimer, the term of this patent is extended or adjusted under 35 U.S.C. 154(b) by 0 days.

(21) Appl. No.: 14/318,235

(22) Filed: Jun. 27, 2014

(65) Prior Publication Data

US 2015/0006181 A1 Jan. 1, 2015

Related U.S. Application Data

(60) Provisional application No. 61/841,276, filed on Jun. 28, 2013.

(51) Int. Cl.
*H04R 1/06* (2006.01)
*G10L 99/00* (2013.01)
(Continued)

(52) U.S. Cl.
CPC ..... *H04R 1/08* (2013.01); *G10L 99/00* (2013.01); *H04R 1/005* (2013.01); *H04R 2201/003* (2013.01)

(58) Field of Classification Search
CPC ..... H04R 1/08; H04R 1/05; H04R 2201/003; G10L 99/00
(Continued)

(56) References Cited

U.S. PATENT DOCUMENTS 5,091,936 A * 2/1992 Katznelson ..... H04H 20/103 348/462
5,243,659 A * 9/1993 Stafford ..... A42B 3/303 381/110
(Continued)

FOREIGN PATENT DOCUMENTS

| | | |
|---|---|---|
| EP | 2 445 228 | 4/2012 |
| WO | WO 03/059005 | 7/2003 |
| WO | WO 2011/097226 | 8/2011 |

OTHER PUBLICATIONS

John J. H. Oh, Full Digital Amplifier for Mobile and Handheld Devices, AES 29th International Conference, Seoul, Korea, Sep. 2-4, 2006.*

(Continued)

*Primary Examiner* — Edwin S Leland, III
(74) *Attorney, Agent, or Firm* — Hamilton, Brook, Smith & Reynolds, P.C.

(57) ABSTRACT

The invention is a multi-microphone voice processing SoC primarily for head worn applications. It bypasses the use of conventional pre-amp voice CODEC (ADC/DAC) chips all together by replacing their functionality with digital MEMS microphone(s) and digital speaker driver (DSD). Functionality necessary for speech recognition such as noise/echo cancellation, speech compression, speech feature extraction and lossless speech transmission are also integrated into the SoC. One embodiment is a noise cancellation chip for wired, battery powered headsets and earphones, as smart-phone accessory. Another embodiment is as a wireless Bluetooth noise cancellation companion chip. The invention can be used in headwear, eyewear glass, mobile wearable computing, heavy duty military, aviation and industrial headsets and other speech recognition applications in noisy environments.

20 Claims, 8 Drawing Sheets

(51) Int. Cl.
*H04R 1/08* (2006.01)
*H04R 1/00* (2006.01)

(58) Field of Classification Search
USPC ..... 704/270
See application file for complete search history.

(56) References Cited

U.S. PATENT DOCUMENTS 5,654,707 A * 8/1997 Matsumoto ..... H03M 7/04 341/101
5,715,309 A * 2/1998 Bartkowiak ..... H04M 9/085 379/339
6,373,955 B1 * 4/2002 Hooley ..... H03K 7/08 381/332
6,529,608 B2 * 3/2003 Gersabeck ..... B60R 16/0373 381/110
7,472,048 B2 12/2008 Puckette
2003/0053793 A1 * 3/2003 Holzmann ..... G11C 7/16 386/328
2004/0174279 A1 * 9/2004 Heo ..... G11B 20/10527 341/106
2005/0047611 A1 * 3/2005 Mao ..... G10L 21/0208 381/94.7
2005/0261789 A1 * 11/2005 Chen ..... H04W 4/18 700/94
2007/0205736 A1 * 9/2007 Lindberg ..... G01D 5/24452 318/490
2008/0205668 A1 * 8/2008 Torii ..... H04R 1/326 381/113
2009/0167431 A1 * 7/2009 Guilherme ..... H03F 3/187 330/10
2011/0135130 A1 * 6/2011 Yamamoto ..... H04R 25/353 381/321
2011/0148677 A1 * 6/2011 Ihs ..... H03F 3/2175 341/143
2012/0075177 A1 * 3/2012 Jacobsen ..... G06F 3/011 345/156
2012/0082325 A1 * 4/2012 Sakurauchi ..... B81C 1/00666 381/174
2013/0223635 A1 * 8/2013 Singer ..... H04R 1/1041 381/56
2013/0223652 A1 * 8/2013 Sahandiesfanjani ..... H03F 1/30 381/121
2014/0184337 A1 * 7/2014 Nobbe ..... H03F 1/0227 330/296
2014/0257813 A1 * 9/2014 Mortensen ..... G10L 15/02 704/251
2014/0278385 A1 * 9/2014 Fan ..... G02C 11/10 704/226
2014/0307884 A1 * 10/2014 Asada ..... G10K 11/178 381/71.6
2014/0321688 A1 * 10/2014 Asada ..... H04R 3/04 381/375
2014/0348370 A1 * 11/2014 Huang ..... H04R 1/08 381/361
2015/0006181 A1 * 1/2015 Fan ..... H04R 1/08 704/270

OTHER PUBLICATIONS

ROHM Semiconductor, Class-D Speaker Amplifier for Digital Input with Built-in DSP, BM5446EFV, May 2010 Rev.B, http://rohmfs.rohm.com/en/products/databook/datasheet/ic/audio_video/audio_amplifier/bm5446efv-e.pdf.*
Transmittal of International Search Report and Written Opinion dated Nov. 27, 2014 for PCT/US2014/044697 entitled "Digital Voice Processing Method and System for Headset Computer".
"Digital Microphones—Applications and System Partitioning" LM4665, LMV1012, Texas Instruments, Literature No. SNAA101; , Jan. 1, 2011.
"Middle Power Class-D Speaker Amplifier Series 20W+20W Full Digital Speaker Amplifier with Built-In DSP" Rohm Co, Ltd. Sep. 10, 2012.

* cited by examiner

DIGITAL VOICE PROCESSING METHOD AND SYSTEM FOR HEADSET COMPUTER

RELATED APPLICATION

This application claims the benefit of U.S. Provisional Application No. 61/841,276, filed on Jun. 28, 2013. The entire teachings of the above application are incorporated herein by reference.

BACKGROUND OF THE INVENTION

Handheld consumer electronic products requiring microphones have traditionally used the electret condenser microphone (ECM). ECMs have been in commercial use since the 1960's and are approaching the limits of their technology. Consequently, ECMs no longer meet the needs of the mobile consumer electronics market.

Microelctromechanical systems (MEMS) consist of various sensors and mechanical devices that are implemented using CMOS (complementary metal-oxide semiconductor) technology for integrated circuits (ICs). MEMS microphones have several advantageous features over ECMs. MEMS microphones can be made much smaller than ECMs and have superior vibration/temperature performance and stability. MEMS technology facilitates additional electronics such as amplifiers and A/D (analog-to-digital) converters to be integrated into the microphone.

SUMMARY OF THE INVENTION

The present invention relates in general to voice processing, and more particularly to multi-microphone digital voice processing, primarily for head worn applications.

A digital MEMS microphone combines, on the same substrate, an analog-to-digital converter (ADC) with an analog MEMS microphone, resulting in a microphone capable of producing a robust digital output signal. The majority of acoustic applications in portable electronic devices require the output of an analog microphone to be converted to a digital signal prior to processing. So the use of a MEMS microphone with a built in ADC results in simplified design as well as better signal quality. Digital MEMS microphones provide several advantages over ECMs and analog MEMS microphones such as better immunity to RF and EMI, superior power supply rejection ratio (PSRR), insensitivity to supply voltage fluctuation and interference, simpler design, easier implementation and therefore, faster time-to-market. For three or more microphone arrays, digital MEMS microphones allow for easier signal processing than their analog counterparts. Digital MEMS microphones also have numerous advantages for multi-microphone noise cancellation applications over analog MEMS microphones and ECMs.

In one aspect, the invention is a voice processing system-on-a-chip (SoC) that obviates the need for conventional pre-amplifier chips, voice CODEC chips, ADC chips and digital-to-analog converter (DAC) chips, by replacing the functionality of these devices with one or more digital microphones (e.g., digital MEMS microphones) and digital speaker driver (DSD). Functionality necessary for speech recognition such as noise/echo cancellation, speech compression, speech feature extraction and lossless speech transmission may also be integrated into the SoC.

In one aspect, the invention is a voice processing apparatus, including an interface configured to receive a first digital audio signal. The interface is implemented on an integrated circuit substrate. The apparatus further includes a processor configured to contribute to the implementation of an audio processing function. The processor is implemented on the integrated circuit substrate, and the audio processing function is configured to transform the first digital audio signal to produce a second digital audio signal. The apparatus further includes a digital speaker driver configured to provide a third digital audio signal to at least one audio speaker device. The third digital audio signal is a direct digital audio signal and the digital speaker driver being implemented on the integrated circuit substrate.

One embodiment further includes a digital anti-aliasing filter configured to provide a filtered audio signal to the digital speaker driver. In one embodiment, the audio processing function includes at least one of: (i) voice preprocessing, (ii) noise cancellation, (iii) echo cancellation, (iv) multiple-microphone beam-forming, (v) voice compression, (vi) speech feature extraction and (vii) lossless transmission of speech data, or other audio processing functions known in the art. In another embodiment, the audio processing function includes a combination of at least two of the above-mentioned audio processing functions.

In one embodiment, the second signal is a pulse width modulation signal. In another embodiment, the digital speaker driver includes a wave shaper for transforming an audio signal into a shaped audio signal, and a pulse width modulator for producing a pulse width modulated signal based on the shaped audio signal. In another embodiment, the wave shaper includes a look-up table configured to produce the shaped audio signal based the audio signal. The look-up table may be a programmable memory device, with the input signal arranged to drive the address inputs of the programmable memory device and the programmable memory device programmed to provide a specific output for a particular set of inputs. In another embodiment, the digital speaker driver further including a sampling circuit configured to sample and hold a digital audio signal, and a driver to convey the modulated signal to a termination external to the voice processing apparatus. This termination may include a sound producing device such as an earphone speaker or broadcast speaker, or it may include an amplifying device for subsequently driving a large audio producing device.

Another embodiment further includes a digital to analog converter configured to receive a digital audio signal generated on the integrated circuit substrate and to generate an analog audio signal therefrom. Another embodiment further includes a wireless transceiver being implemented on the integrated circuit substrate. The wireless transceiver may include a Bluetooth transceiver (i.e., combination transmitter and receiver and necessary support processing components) or a WiFi (IEEE 802.11) transceiver, or other such wireless transmission protocol transceiver known in the art.

Another embodiment further includes a mobile wearable computing device configured to communicate with the processor. The mobile wearable computing device is configured to receive user input through sensing voice commands, head movements and hand gestures or any combination thereof. One embodiment further includes a host interface configured to communicate with an external host.

In one embodiment, the digital speaker driver includes (i) a sample and hold block configured to sample and hold a digital audio signal, (ii) a wave shaper configured to shape the sampled digital audio signal, (iii) a pulse width modulator configured to modulate the shaped signal, and (iv) a driver to convey the modulated signal.

In another aspect, the invention includes a tangible, non-transitory, computer readable medium for storing computer executable instructions processing voice signals, with the computer executable instructions for receiving, on an integrated circuit substrate, a first digital audio signal; providing, by a digital speaker driver on an integrated circuit substrate, a third digital audio signal to at least one audio speaker device. The third digital audio signal is a direct digital audio signal; and implementing, on an integrated circuit substrate, an audio processing function configured to transform the first digital audio signal to produce a second digital audio signal.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1A:
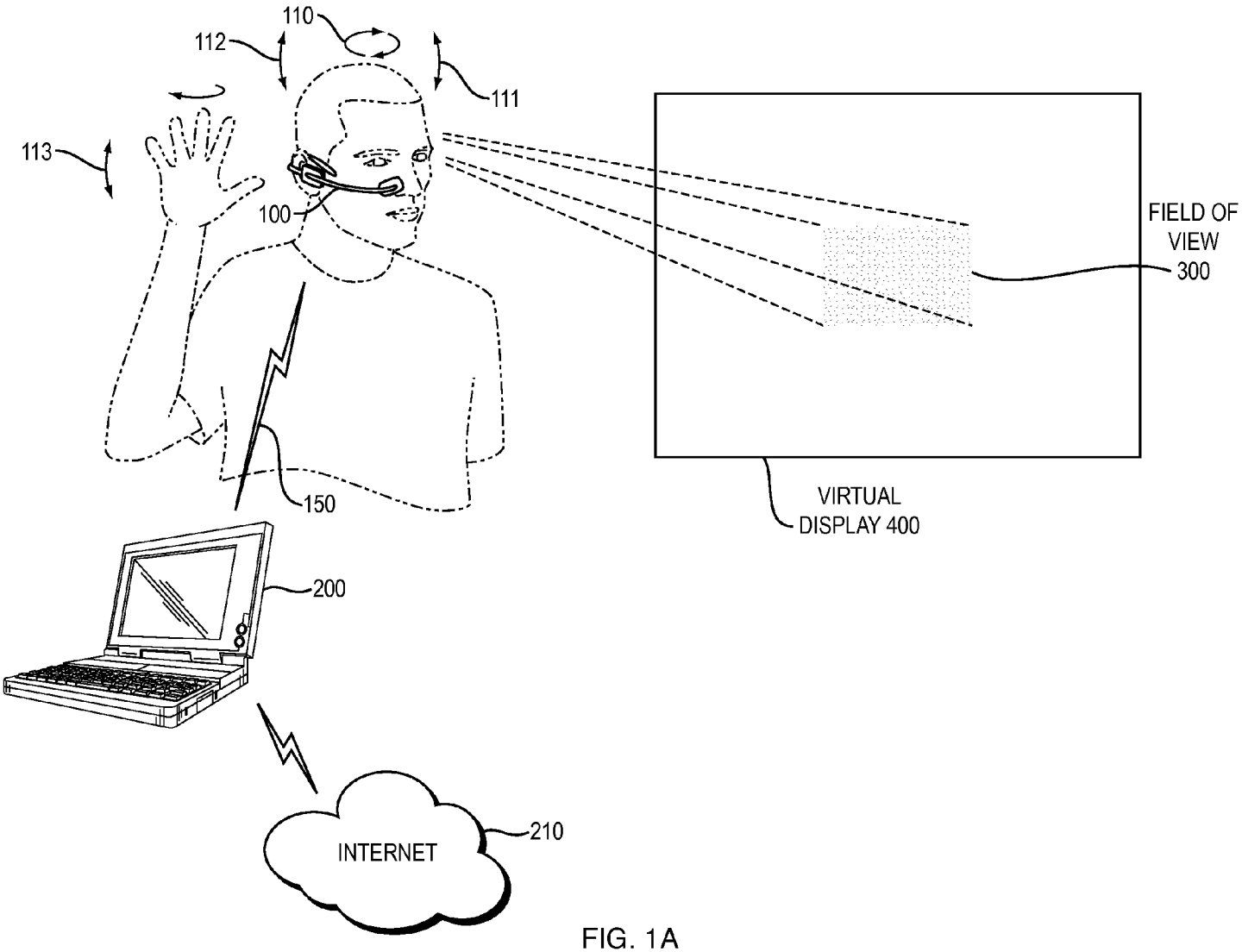
FIG. 1A is perspective view of a wireless computing headset device (also referred to herein as a headset computer (HSC)).
Figure 1B:
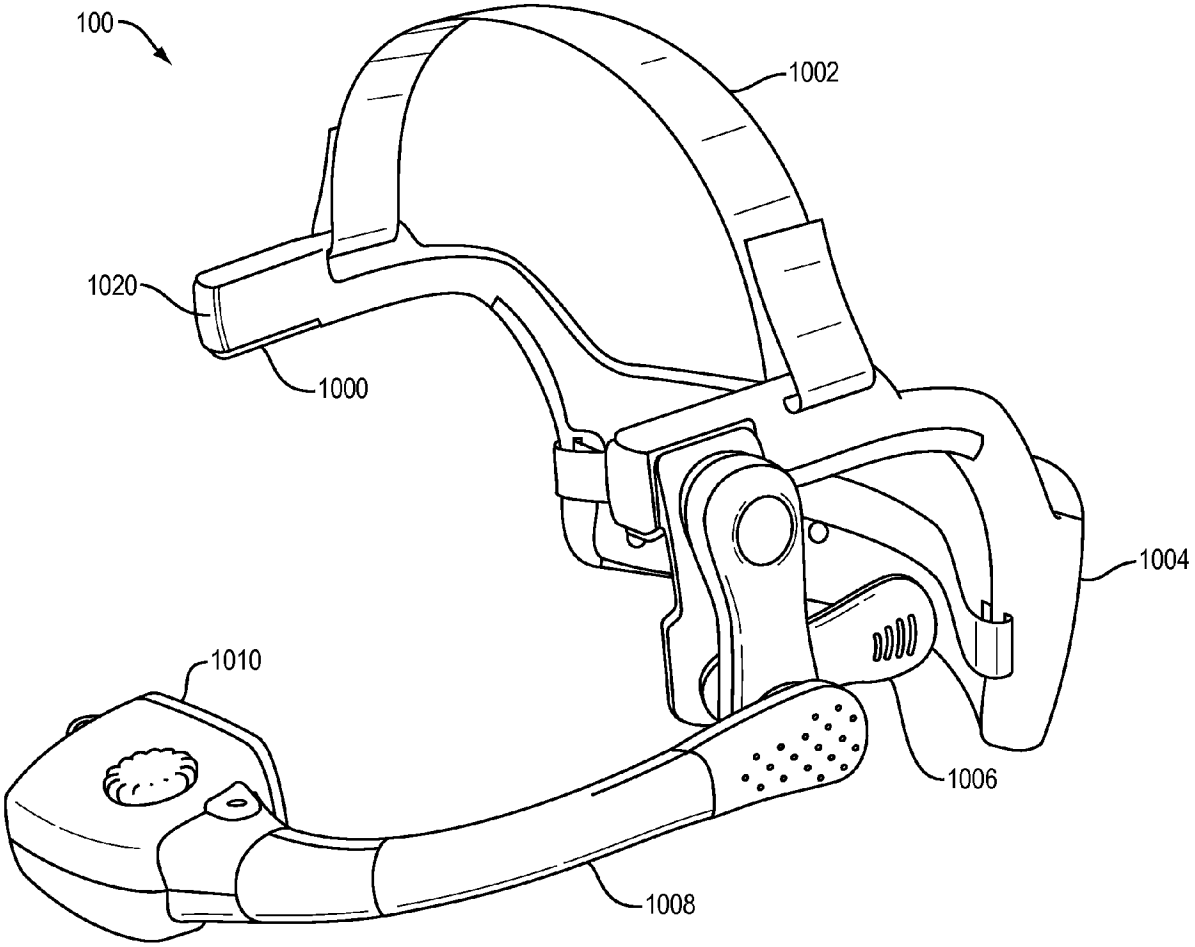
FIG. 1B is a perspective view showing details of a HSC device.

FIGS. 1A and 1B show an embodiment of a wireless headset computer (HSC) 100 that incorporates a high-resolution (VGA or better) microdisplay element 1010, and other features described below. HSC 100 can include audio input and/or output devices, including one or more microphones, speakers, geo-positional sensors (GPS), three to nine axis degrees of freedom orientation sensors, atmospheric sensors, health condition sensors, digital compass, pressure sensors, environmental sensors, energy sensors, acceleration sensors, position, attitude, motion, velocity and/or optical sensors, cameras (visible light, infrared, etc.), multiple wireless radios, auxiliary lighting, rangefinders, or the like and/or an array of sensors embedded and/or integrated into the headset and/or attached to the device via one or more peripheral ports (not shown in detail in FIG. 1B). Typically located within the housing of headset computing device 100 are various electronic circuits including, a microcomputer (single or multi-core processors), one or more wired and/or wireless communications interfaces, memory or storage devices, various sensors and a peripheral mount or a mount such as a "hot shoe."

Example embodiments of the HSC 100 can receive user input through sensing voice commands, head movements, 110, 111, 112 and hand gestures 113, or any combination thereof. Microphone(s) operatively coupled or preferably integrated into the HSC 100 can be used to capture speech commands which are then digitized and processed using automatic speech recognition techniques. Gyroscopes, accelerometers, and other micro-electromechanical system sensors can be integrated into the HSC 100 to track the user's head movement for user input commands. Cameras or other motion tracking sensors can be used to monitor a user's hand gestures for user input commands. Such a user interface overcomes the hands-dependent formats of other mobile devices.

The HSC 100 can be used in various ways. It can be used as a remote display for streaming video signals received from a remote host computing device 200 (shown in FIG. 1A). The host 200 may be, for example, a notebook PC, smart phone, tablet device, or other computing device having less or greater computational complexity than the wireless computing headset device 100, such as cloud-based network resources. The host may be further connected to other networks 210, such as the Internet. The headset computing device 100 and host 200 can wirelessly communicate via one or more wireless protocols, such as Bluetooth®, Wi-Fi, WiMAX or other wireless radio link 150. (Bluetooth is a registered trademark of Bluetooth Sig, Inc. of 5209 Lake Washington Boulevard, Kirkland, Wash. 98033.) In an example embodiment, the host 200 may be further connected to other networks, such as through a wireless connection to the Internet or other cloud-based network resources, so that the host 200 can act as a wireless relay. Alternatively, some example embodiments of the HSC 100 can wirelessly connect to the Internet and cloud-based network resources without the use of a host wireless relay.

FIG. 1B is a perspective view showing some details of an example embodiment of a HSC 100. The example embodiment of a HSC 100 generally includes, a frame 1000, strap 1002, rear housing 1004, speaker 1006, cantilever, or alternatively referred to as an arm or boom 1008 with a built in microphone(s), and a micro-display subassembly 1010. Of interest to the present disclosure is the detail shown wherein one side of the HSC 100 opposite the cantilever arm 1008 is a peripheral port 1020. The peripheral port 1020 provides corresponding connections to one or more accessory peripheral devices (as explained in detail below), so a user can removably attach various accessories to the HSC 100. An example peripheral port 1020 provides for a mechanical and electrical accessory mount such as a hot shoe. Wiring carries electrical signals from the peripheral port 1020 through, for example, the back portion 1004 to circuitry disposed therein. The hot shoe attached to peripheral port 1020 can operate much like the hot shoe on a camera, automatically providing connections to power the accessory and carry signals to and from the rest of the HSC 100.

Various types of accessories can be used with peripheral port 1020 to provide hand movements, head movements, and/or vocal inputs to the system, such as but not limited to microphones, positional, orientation and other previously described sensors, cameras, speakers, and the like. It should be recognized that the location of the peripheral port (or ports) 1020 can be varied according to the various types of accessories to be used and with other embodiments of the HSC 100.

A head worn frame 1000 and strap 1002 are generally configured so that a user can wear the HSC 100 on the user's head. A housing 1004 is generally a low profile unit which houses the electronics, such as the microprocessor, memory or other storage device, low power wireless communications device(s), along with other associated circuitry. Speakers 1006 provide audio output to the user so that the user can hear information, such as the audio portion of a multimedia presentation, or audio alert or feedback signaling recognition of a user command. Microdisplay subassembly 1010 is used to render visual information to the user. It is coupled to the arm 1008. The arm 1008 generally provides physical support such that the microdisplay subassembly is able to be positioned within the user's field of view 300 (FIG. 1A), preferably in front of the eye of the user or within its peripheral vision preferably slightly below or above the eye. Arm 1008 also provides the electrical or optical connections between the microdisplay subassembly 1010 and the control circuitry housed within housing unit 1004.

According to aspects that will be explained in more detail below, the HSC display device 100 allows a user to select a field of view 300 within a much larger area defined by a virtual display 400. The user can typically control the position, extent (e.g., X-Y or 3D range), and/or magnification of the field of view 300. While what is shown in FIGS. 1A-1B are HSCs 100 with monocular microdisplays presenting a single fixed display element supported within the field of view in front of the face of the user with a cantilevered boom, it should be understood that other mechanical configurations for the remote control display device HSC 100 are possible.

Figure 2:
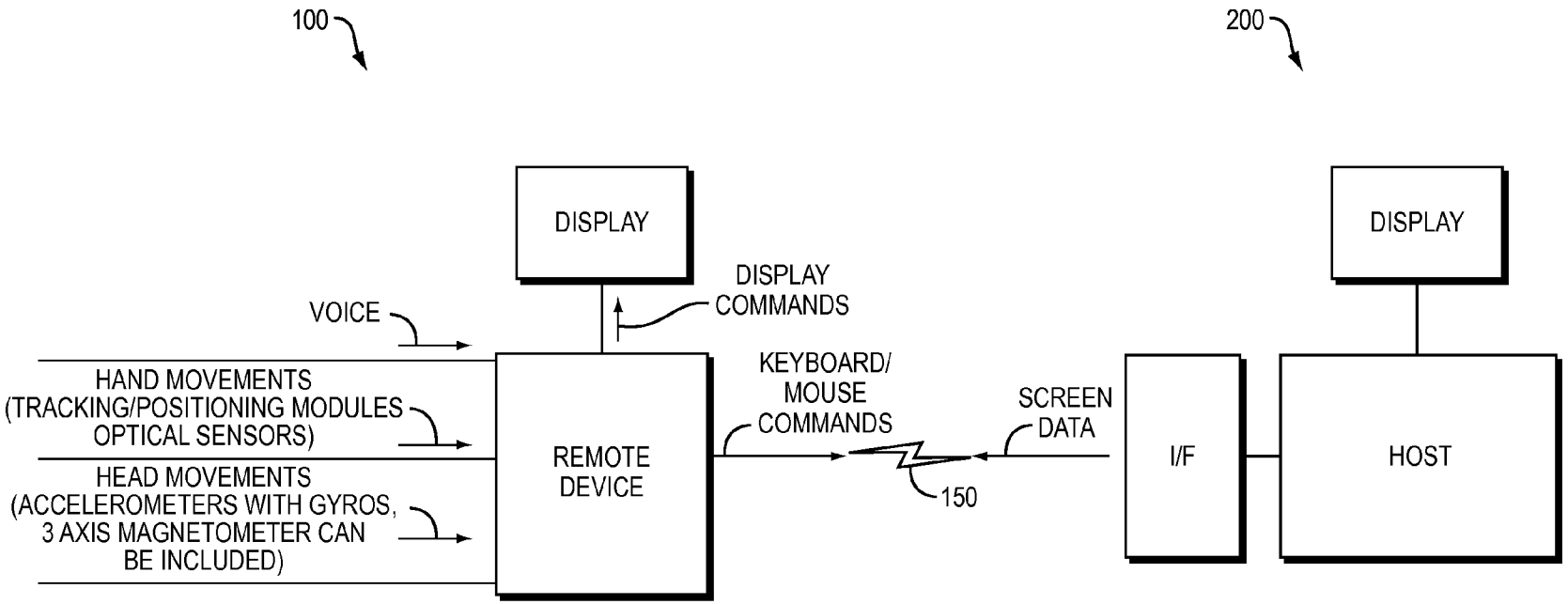
FIG. 2 is a block diagram showing more details of the HSC device, the host and the data that travels between them in an embodiment of the present invention.

FIG. 2 is a block diagram showing more detail of the example HSC device 100, host 200 and the data that travels between them. The HSC device 100 receives vocal input from the user via the microphone, hand movements or body gestures via positional and orientation sensors, the camera or optical sensor(s), and head movement inputs via the head tracking circuitry such as 3 axis to 9 axis degrees of freedom orientational sensing. These user inputs are translated by software in the HSC 100 into commands (e.g., keyboard and/or mouse commands) that are then sent over the Bluetooth or other wireless interface 150 to the host 200. The host 200 then interprets these translated commands in accordance with its own operating system/application software to perform various functions. Among the commands is one to select a field of view 300 within the virtual display 400 and return that selected screen data to the HSC 100. Thus, it should be understood that a very large format virtual display area might be associated with application software or an operating system running on the host 200. However, only a portion of that large virtual display area 400 within the field of view 300 is returned to and actually displayed by the micro display 1010 of HSC 100.

In one example embodiment, the HSC 100 may take the form of the HSC described in a co-pending U.S. Patent Publication No. 2011/0187640 entitled "Wireless Hands-Free Computing Headset With Detachable Accessories Controllable By Motion, Body Gesture And/Or Vocal Commands" by Pombo et al. filed Feb. 1, 2011, which is hereby incorporated by reference in its entirety.

In another example embodiment, the invention may relate to the concept of using a HSC (or Head Mounted Display (HMD)) 100 with microdisplay 1010 in conjunction with an external 'smart' device 200 (such as a smartphone or tablet) to provide information and hands-free user control. The invention may require transmission of small amounts of data, providing a more reliable data transfer method running in real-time. In this sense therefore, the amount of data to be transmitted over the wireless connection 150 is small—simply instructions on how to lay out a screen, which text to display, and other stylistic information such as drawing arrows, or the background colors, images to include, etc.

Figure 3:
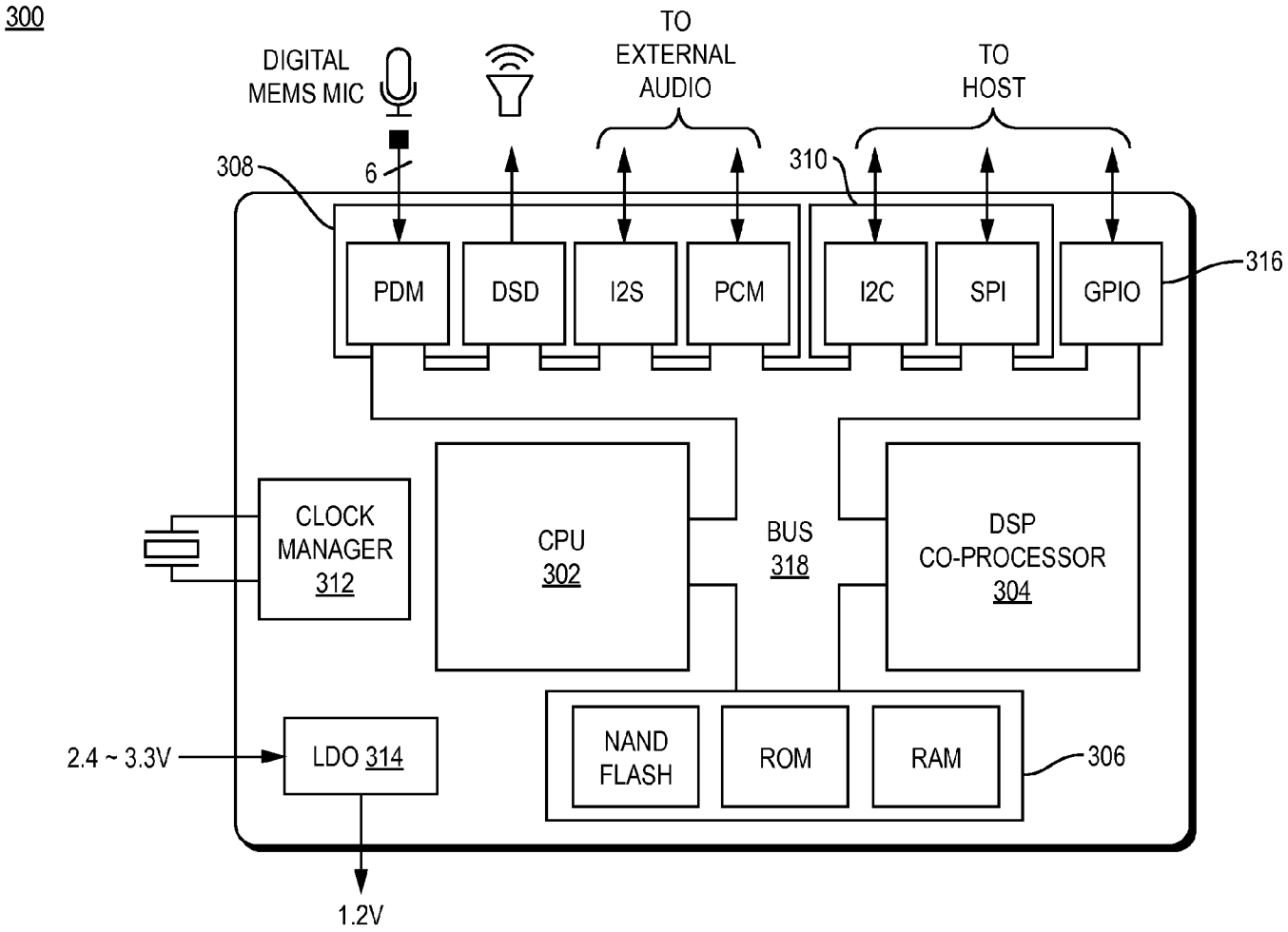
FIG. 3 is a block diagram showing a noise cancelled microphone signal converted back to an analog signal using a separate DAC (digital-to-analog converter) in one embodiment.

In one aspect, the invention is a multiple microphone (i.e., one or more microphones), all digital voice processing System on Chip (SoC), which may be used for head worn applications such as the one shown in FIGS. 1A and 1B. One example of a digital voice processing SoC 300 according to the described embodiments is shown in FIG. 3. This example include a processor 302, a co-processor 304, memory 306, an audio interface module 308, a host interface module 310, a clock manager 312, a low drop-out (LDO) voltage regulator 314, and a general purpose I/O (GPIO) interface 316, all tied together by a bus 318. While these elements are example components for a digital SoC according to the described embodiments, some embodiments may include only a subset of the elements shown in FIG. 3, while other embodiments may include additional functionality appropriate for a digital voice processing SoC. Some embodiments may integrate one or more of the digital microphones directly onto the SoC substrate. The example embodiments describe the use of digital MEMS microphones in particular, but it should be understood that other types of digital or other microphones may also be used.

The audio interface module 308 may include a pulse density modulated (PDM) interface for receiving input from one or more digital MEMS microphones, a digital speaker driver (DSD) interface, an inter-IC sound ($I^2S$) interface and a pulse code modulation (PCM) interface. The host interface 310 may include an inter-IC ($I^2C$) interface and a serial peripheral interface (SPI).

Figure 4:
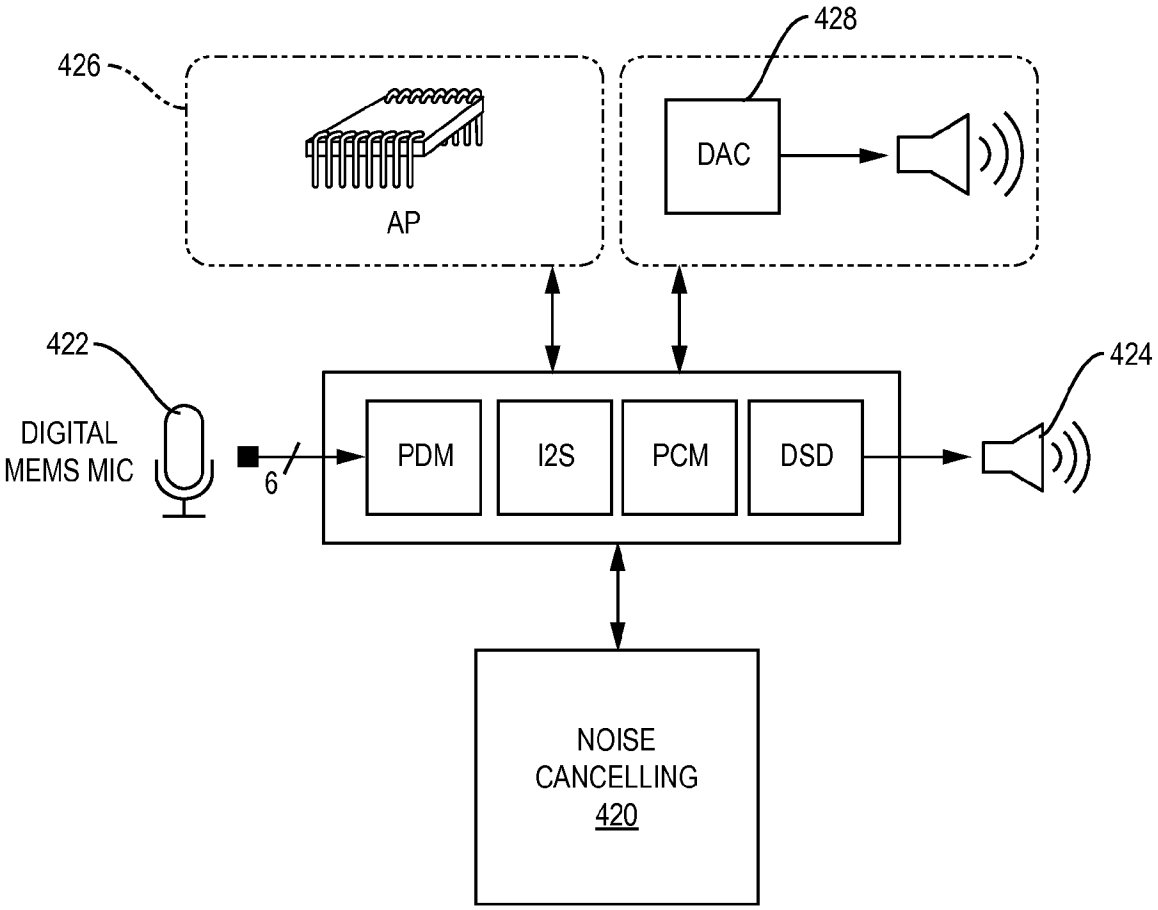
FIG. 4 is a block diagram of another embodiment.

One embodiment may include a voice processing application SoC that implements one or more of the following voice processing functions implemented at least in part by code stored in memory 306 and executing on the processor 302 and/or co-processor 304: voice pre-processing, noise cancellation, echo cancellation, multiple microphone beamforming, voice compression, speech feature extraction, and lossless transmission of speech data. This example embodiment may be used for wired, battery powered headsets and earphones, such as an accessory that might be used in conjunction with a smartphone. FIG. 4 shows one such example accessory, which includes a noise cancelling function 420 in addition to receiving digital MEMS microphone outputs 422 and driving a speaker 424. Such an embodiment may also provide, as an option, an application processor 426 that implements additional functionality, along with a digital to analog converter (DAC) 428 for driving an analog audio signal to an external speaker. In some embodiments the application processor 422 may be integrated with the SoC along with other functionality (e.g., noise canceling), while in other embodiments the application processor 422 may be a separate integrated circuit that works in conjunction with the SoC. Similarly, the DAC may be external or it may be included within the SoC.

Figure 5:
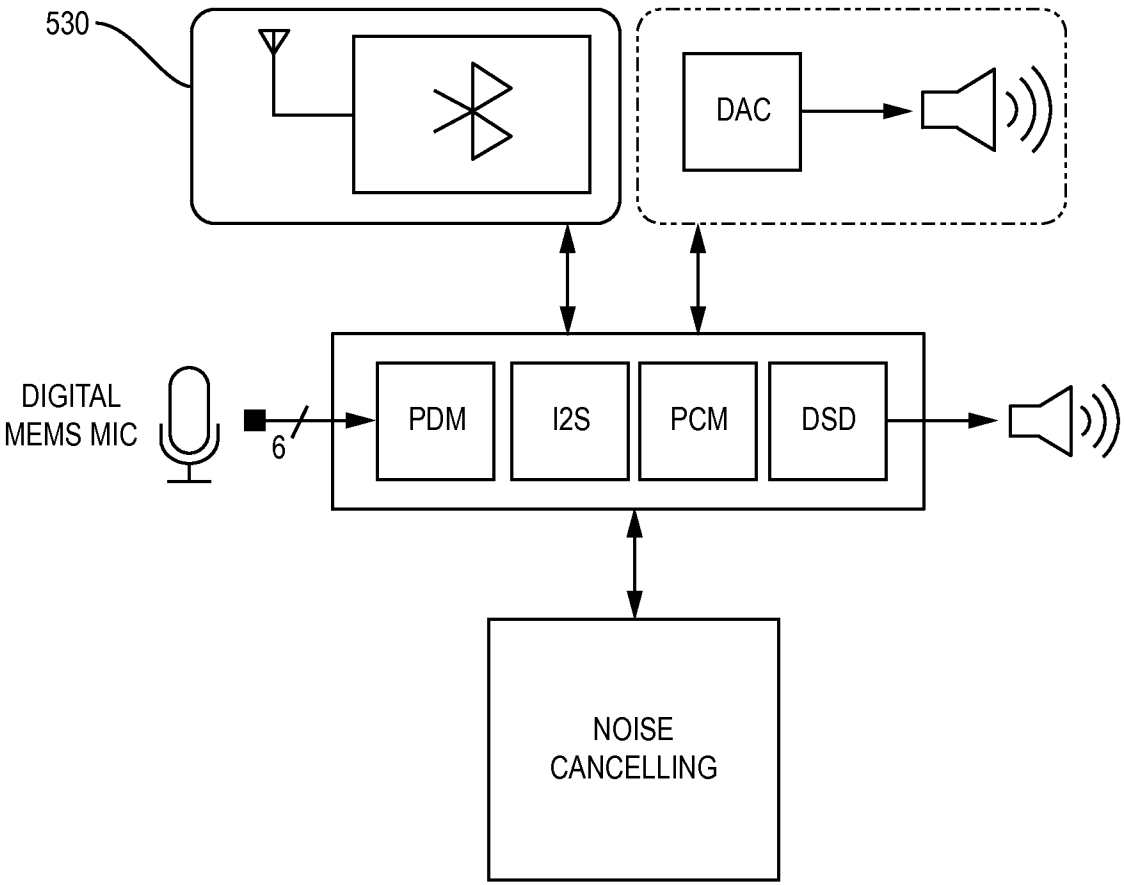
FIG. 5 shows details of the DSD (digital signal driver) in embodiments.

Another embodiment may include a wireless Bluetooth noise cancellation companion chip, an example of which is shown in FIG. 5. This SoC embodiment provides the noise cancellation and interface to MEMS microphones and speaker, but also provides Bluetooth receive/transmit and processing functions 530 all on a single IC device.

It should be understood that for the example embodiments shown in FIGS. 3, 4 and 5, while the audio input to the SoC is shown provided directly from MEMS microphone outputs (e.g., reference number 422), in other embodiments the audio input may be provided by other sources, or by a combination of the one or more digital microphone outputs, and one or more analog microphone outputs each driven through an analog to digital converter (ADC).

The incoming audio signal may originate at a remote location (e.g., a person speaking into a microphone of a mobile phone), and be encoded and transmitted (e.g., through a cellular network) to a local receiver where the signal would be decoded and provided to the SoC of FIG. 3, 4 or 5. The incoming audio processed by the SoC may be sent to a speaker through an external DAC or through the DSD directly.

For outgoing audio, the SoC may receive an audio signal from the one or more digital MEMS microphones 422 and provide a processed audio signal to audio compression encoding and subsequent transmission over a communication path (e.g., a cellular network).

The described embodiments may be used for example in headwear, eyewear glass, mobile wearable computing, heavy duty military products, aviation and industrial headsets and other speech recognition applications suitable for operating in noisy environments.

In one embodiment, the SoC may support one or more digital MEMS microphone inputs and one or more digital outputs. The digital voice processing SoC may function as a voice preprocessor similar to a microphone pre-amplifier, while also performing noise/echo cancellation and voice compression, such as SBC, Speex and DSR.

Compared to digital voice processing systems that utilize ECMs, the digital voice processing SoC according to the described embodiments operates at a low voltage (for example, at 1.2 VDC), has extremely low power consumption, small size, and low cost. The digital voice processing SoC can also support speech feature extraction, and lossless speech data transmission via Bluetooth, Wi-Fi, 3G, LTE etc.

The SoC may also support peripheral interfaces such as general purpose input/output (GPIO) pins, and host interfaces such as SPI, UART, I2C, and other such interfaces. In one embodiment, the SoC may support an external crystal and clock. The SoC may support memory architecture such as on-chip unified memory with single cycle program/data access, ROM for program modules and constant look up tables, SRAM for variables and working memory, and memory mapped Register Banks. The SoC can support digital audio interfaces such as digital MEMS microphone interface, digital PWN earphone driver, bi-directional serialized stereo PCM and bi-directional stereo I2S.

CPU hardware that the SoC can support includes a CPU main processor, DSP accelerator coprocessor, and small programmable memory (NAND FLASH) for application flexibility.

Figure 6:
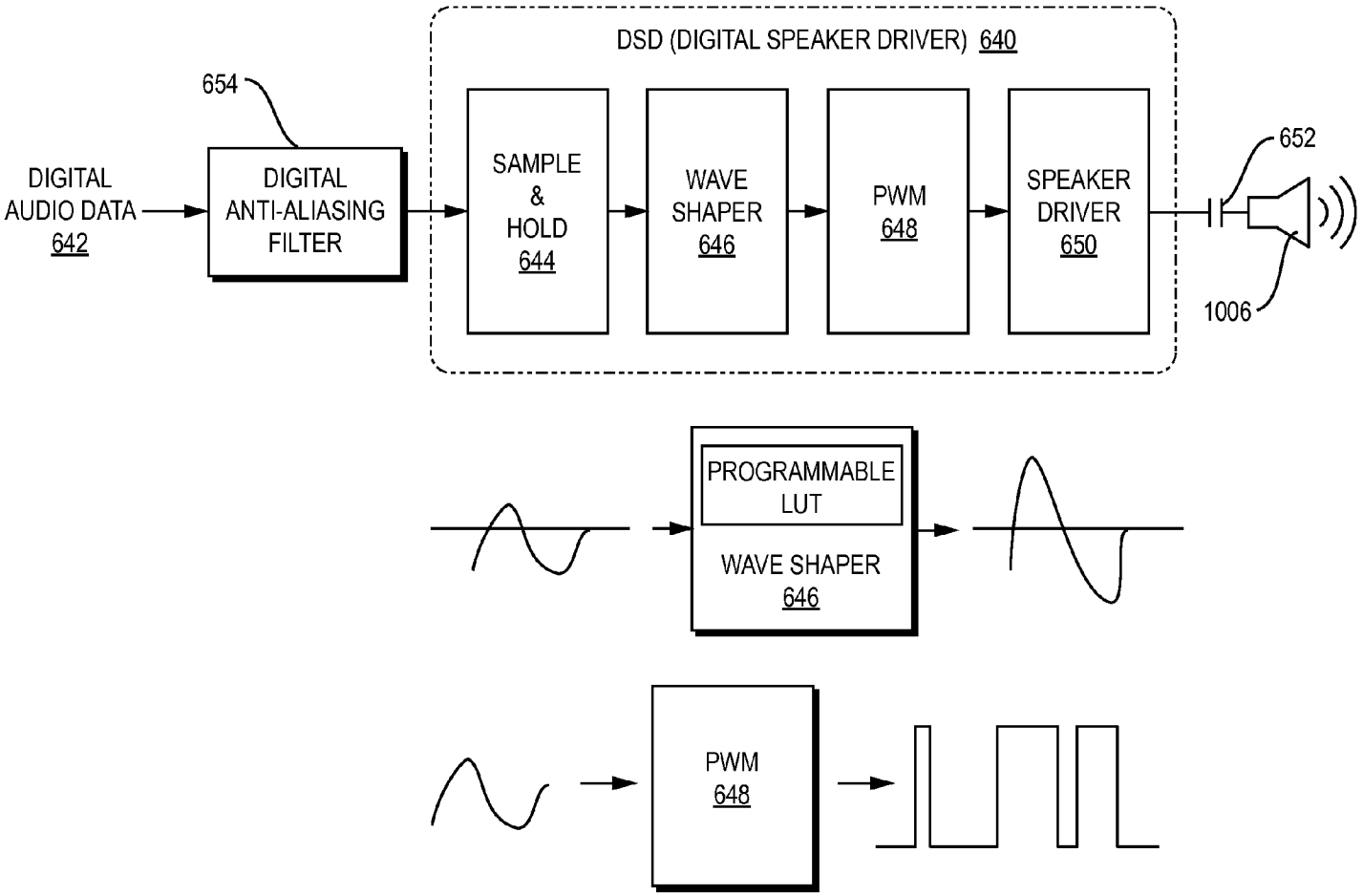
FIG. 6 shows details of another DSD (digital signal driver) in embodiments.

FIG. 6 shows example details of the digital speaker driver (DSD) 640 on a SoC according to the described embodiments. The DSD is specifically designed and implemented for voice processing. The digital audio data 642 input into the DSD first goes through a sample and hold block 644, then a wave shaper block 646, then a pulse width modulation (PWM) block 648, and finally, the speaker driver 650 that directly drives the earphone speaker 1006. The wave shaper 646 uses a programmable lookup table (LUT) to convert digital samples (e.g., PCM compression from 16-bit to 10-bit). The PWM modulator converts a digital signal to a pulse train. Finally, a speaker driver 650 (in this example, an FET driver) drives the earphone speaker 1006. An external capacitor 652 and the speaker together form a LC low pass filter to filter out high frequency noise from the signal as it goes into the earphone speaker 1006.

The DSD output stage is over-sampled at hundreds of times the audio sampling rate. In one embodiment, the DSD output stage further incorporates an error correction circuit, such as a negative feedback loop. The DSD may also be used for incoming voice data at the earphone. Finally, if the noise-cancelled microphone signal needs to be converted back to an analog signal, a separate DAC (e.g., DAC 428 in FIG. 4) may be used to minimize signal distortion as shown in FIG. 4.

Figure 7:
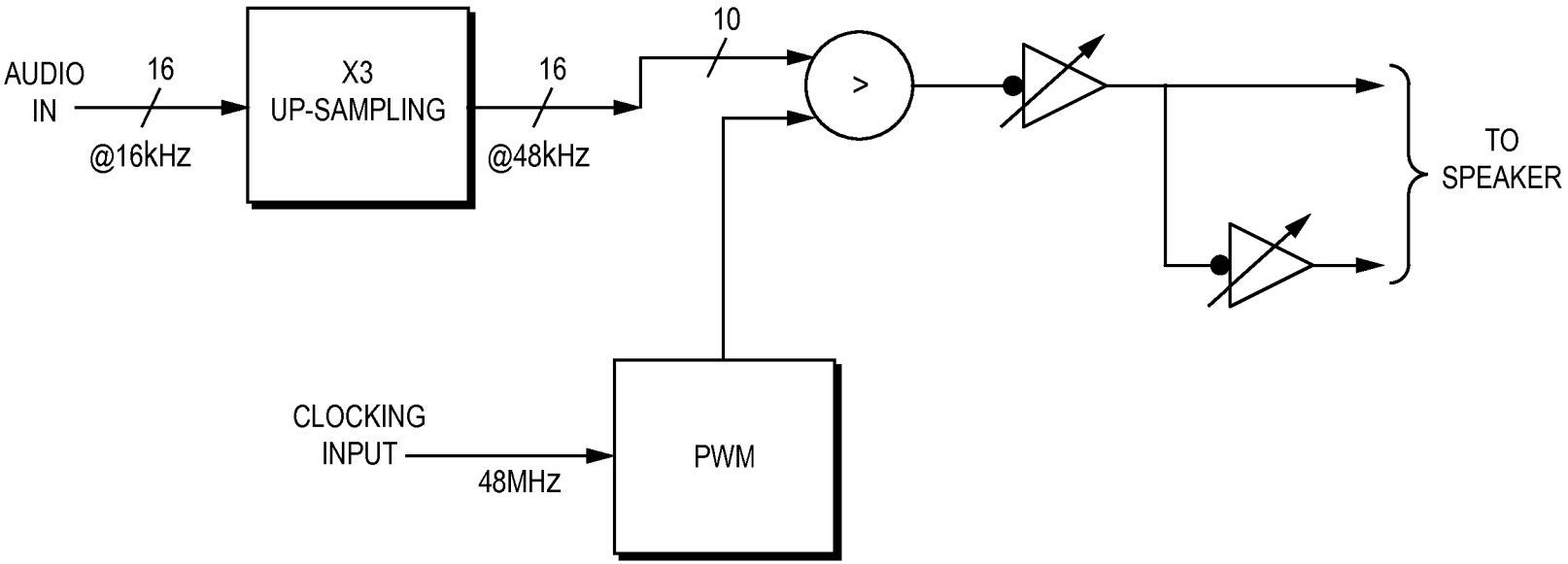
FIG. 7 illustrates details of yet another DSD (digital signal driver) in embodiments.

In some embodiments, the sample and hold block 644 may be preceded by a digitally-implemented anti-aliasing filter 654, so that the digital audio data 642 is received by the digital anti-aliasing filter 654 and the data processed by the digital anti-aliasing filter 654 is passed on to the sample and hold block 644. Such a digital anti-aliasing filter 654 may be a component of the DSD, or it may be a component separate from the DSD. In one embodiment, as shown in FIG. 7, the digital anti-aliasing filter 654 may be a 1:3 up-sample filter, so that an example 16 bit, 16 kHz sampling rate input would result in a 16 bit, 48 kHz sampling rate output, although other filtering ratios, sampling rates and bit widths may also be used. In such an example, a PWM resolution of 1024/sample results in a PWM clock of approximately 48 MHz.

In embodiments such as those described above, the digital anti-aliasing filter 654 may reduce or eliminate an aliasing effect in the digital domain, prior to being sent to a speaker 1006. This may reduce or eliminate aliasing at frequencies less than the upper limit of human hearing (e.g., 24 kHz), so that the external analog components 652 may not be needed. Reducing or eliminating such external analog components 652 may conserve printed circuit board space, simplify assembly and increase reliability of the DSD, among other benefits.

It will be apparent that one or more embodiments, described herein, may be implemented in many different forms of software and hardware. Software code and/or specialized hardware used to implement embodiments described herein is not limiting of the invention. Thus, the operation and behavior of embodiments were described without reference to the specific software code and/or specialized hardware—it being understood that one would be able to design software and/or hardware to implement the embodiments based on the description herein Further, certain embodiments of the invention may be implemented as logic that performs one or more functions. This logic may be hardware-based, software-based, or a combination of hardware-based and software-based. Some or all of the logic may be stored on one or more tangible computer-readable storage media and may include computer-executable instructions that may be executed by a controller or processor. The computer-executable instructions may include instructions that implement one or more embodiments of the invention. The tangible computer-readable storage media may be volatile or non-volatile and may include, for example, flash memories, dynamic memories, removable disks, and non-removable disks.

While this invention has been particularly shown and described with references to example embodiments thereof, it will be understood by those skilled in the art that various changes in form and details may be made therein without departing from the scope of the invention encompassed by the appended claims.

What is claimed is:

1. A voice processing apparatus, comprising:

at least two digital MEMS microphones configured to produce at least two digital audio signals, the at least two digital microphones implemented on an integrated circuit substrate;

an interface configured to receive the at least two digital audio signals, the interface being implemented on the integrated circuit substrate;

a processor configured to contribute to the implementation of an audio processing function, the processor being implemented on the integrated circuit substrate, the audio processing function being configured to transform the at least two digital audio signals to produce a processed digital audio signal, the audio processing function comprising noise cancellation, echo cancellation, and multiple-microphone beam-forming; and a digital speaker driver configured to provide a driven digital audio signal to at least one audio speaker device, the driven digital audio signal being a direct digital audio signal and the digital speaker driver being implemented on the integrated circuit substrate, the digital speaker driver comprising (i) a digital anti-aliasing filter configured to transform a frequency characteristic of the processed digital audio signal prior to a sample and hold block of the digital speaker driver, and (ii) a wave shaper configured to convert the processed digital audio signal into a shaped audio signal, through the use of a lookup table, by converting samples of the processed digital audio signal from a first digital format to a second digital format.

2. The voice processing apparatus of claim 1, wherein the at least two digital audio signals includes a signal from the at least two digital microphones.

3. The voice processing apparatus of claim 1, wherein the audio processing function includes at least one of: voice pre-processing, noise cancellation, echo cancellation, multiple-microphone beam-forming, voice compression, speech feature extraction and lossless transmission of speech data.

4. The voice processing apparatus of claim 1, wherein the audio processing function includes a combination of at least two of: voice pre-processing, noise cancellation, echo cancellation, multiple-microphone beam-forming, voice compression, speech feature extraction and lossless transmission of speech data.

5. The voice processing apparatus of claim 1, wherein the driven digital audio signal is a pulse width modulation signal.

6. The voice processing apparatus of claim 1, wherein the digital speaker driver includes a wave shaper for transforming an audio signal into a shaped audio signal, and a pulse width modulator for producing a pulse width modulated signal based on the shaped audio signal.

7. The voice processing apparatus of claim 6, wherein the wave shaper includes a programmable look-up table configured to produce the shaped audio signal based on the audio signal.

8. The voice processing apparatus of claim 1, wherein the digital speaker driver further includes a sampling circuit configured to sample and hold a digital audio signal, and a driver to convey the modulated signal to a termination external to the voice processing apparatus.

9. The voice processing apparatus of claim 1, further including a digital to analog converter configured to receive a digital audio signal generated on the integrated circuit substrate and to generate an analog audio signal therefrom.

10. The voice processing apparatus of claim 1, further including a wireless transceiver being implemented on the integrated circuit substrate.

11. The voice processing apparatus of claim 10, wherein the wireless transceiver includes at least one of a Bluetooth transceiver and a WiFi transceiver.

12. The voice processing apparatus of claim 1, wherein the digital speaker driver is further configured to receive a fourth digital audio signal to be used to generate the driven digital audio signal.

13. The voice processing apparatus of claim 1, further including a mobile wearable computing device configured to communicate with the processor, wherein the mobile wearable computing device is configured to receive user input through sensing voice commands, head movements and hand gestures or any combination thereof.

14. The voice processing apparatus of claim 1, further including a digital anti-aliasing filter configured to provide a filtered audio signal to the digital speaker driver.

15. A tangible, non-transitory, computer readable medium for storing computer executable instructions processing voice signals, with the computer executable instructions for:

receiving, on an integrated circuit substrate, at least two digital audio signals produced by at least two digital MEMS microphones implemented on the integrated circuit substrate;

implementing, on an integrated circuit substrate, an audio processing function configured to transform the at least two audio signals to produce a processed digital audio signal, the audio processing function comprising noise cancellation, echo cancellation, and multiple-microphone beam-forming; and providing, by a digital speaker driver on an integrated circuit substrate, a driven digital audio signal to at least one audio speaker device, the driven digital audio signal being a direct digital audio signal, the digital speaker driver comprising (i) a digital anti-aliasing filter configured to transform a frequency characteristic of the processed digital audio signal prior to a sample and hold block of the digital speaker driver, and (ii) a wave shaper configured to convert the processed digital audio signal into a shaped audio signal, through the use of a lookup table, by converting samples of the processed digital audio signal from a first digital format to a second digital format.

16. The tangible, non-transitory, computer readable medium according to claim 15, wherein the audio processing function includes at least one of: voice pre-processing, noise cancellation, echo cancellation, multiple-microphone beam-forming, voice compression, speech feature extraction and lossless transmission of speech data.

17. The tangible, non-transitory, computer readable medium according to claim 15, wherein the audio processing function includes a combination of at least two of: voice pre-processing, noise cancellation, echo cancellation, multiple-microphone beam-forming, voice compression, speech feature extraction and lossless transmission of speech data.

18. The tangible, non-transitory, computer readable medium according to claim 15, further including computer executable instructions for implementing a digital anti-aliasing filter configured to provide a filtered audio signal to the digital speaker driver.

19. The tangible, non-transitory, computer readable medium according to claim 15, wherein the driven digital audio signal is a pulse width modulation signal.

20. The tangible, non-transitory, computer readable medium according to claim 15, wherein the digital speaker driver includes a wave shaper for transforming an audio signal into a shaped audio signal, and a pulse width modulator for producing a pulse width modulated signal based on the shaped audio signal.

* * * * *